US005786660A

United States Patent [19]

Clerc

[11] Patent Number: 5,786,660

[45] Date of Patent: Jul. 28, 1998

[54] FLAT DISPLAY SCREEN WITH A HIGH INTER-ELECTRODE VOLTAGE

[75] Inventor: Jean-Frédéric Clerc, Saint Egreve, France

[73] Assignee: Pixtech S.A., Rousset, France

[21] Appl. No.: 633,738

[22] PCT Filed: Aug. 23, 1995

[86] PCT No.: PCT/FR95/01105

§ 371 Date: Jul. 29, 1996

§ 102(e) Date: Jul. 29, 1996

[87] PCT Pub. No.: WO96/06450

PCT Pub. Date: Feb. 29, 1996

[30] Foreign Application Priority Data

Aug. 24, 1994 [FR] France ..... 94 10390

[51] Int. Cl.[6] ..... H01J 31/12; H01J 29/82

[52] U.S. Cl. ..... 313/495; 313/496; 313/336

[58] Field of Search ..... 313/495, 496, 313/497, 309, 336

[56] References Cited

U.S. PATENT DOCUMENTS

| | | | |
|---|---|---|---|
| 5,504,387 | 4/1996 | Hamagishi et al. | 313/495 |
| 5,541,473 | 7/1996 | Duboc, Jr. et al. | 313/495 |
| 5,543,684 | 8/1996 | Kumar et al. | 313/495 |
| 5,587,623 | 12/1996 | Jones | 313/497 |

*Primary Examiner*—Nimeshkumar D. Patel
*Attorney, Agent, or Firm*—Plevy & Associates

[57] ABSTRACT

A flat display screen has a cathode including microtips for electronic bombardment associated with a gate, an anode including phosphor elements, and an inter-electrode gap. The screen includes an apertured insulating plate defining the inter-electrode gap associated with means for maintaining the plate apart from the anode.

7 Claims, 2 Drawing Sheets

FLAT DISPLAY SCREEN WITH A HIGH INTER-ELECTRODE VOLTAGE

BACKGROUND OF THE INVENTION

1. Field of the Invention

The present invention relates to the fabrication of a flat display screen. It more particularly applies to a flat display screen comprising a cathode including microtips for electronically bombarding an anode including phosphor elements. This type of screen is commonly called a microtip screen.

2. Discussion of the Related Art

FIG. 1 represents the structure of a flat microtip screen with microtips of the type used according to the invention.

Such microtip screens are mainly constituted by a cathode 1 including microtips 2 and by a gate 3 provided with holes 4 corresponding to the positions of the microtips 2. Cathode 1 is disposed so as to face a cathodoluminescent anode 5, formed on a glass substrate 6 that constitutes the screen surface.

The operation and the detailed structure of such a microtip screen are described in U.S. Pat. No. 4,940,916 assigned to Commissariat à l'Energie Atomique.

The cathode 1 is disposed in columns and is constituted, onto a glass substrate 10, of cathode conductors arranged in meshes from a conductive layer. The microtips 2 are disposed onto a resistive layer 11 that is deposited onto the cathode conductors and are disposed inside meshes defined by the cathode conductors. FIG. 1 partially represents the inside of a mesh, without the cathode conductors. The cathode 1 is associated with the gate 3 which is arranged in rows, an insulating layer (not shown) being interposed between the cathode conductors and gate 3. The intersection of a row of gate 3 with a column of cathode 1 defines a pixel.

This device uses the electric field generated between the cathode 1 and gate 3 so that electrons are transferred from microtips 2 toward phosphor elements 7 of anode 5. In color screens, the anode 5 is provided with alternate phosphor strips 7, each strip corresponding to a color (red, green, blue). The strips are separated one from the other by an insulating material 8. The phosphor elements 7 are deposited onto electrodes 9, which are constituted by corresponding strips of a transparent conductive layer such as indium and tin oxide (ITO). The groups of red, green, blue strips are alternatively biased with respect to cathode 1 so that the electrons extracted from the microtips 2 of one pixel of the cathode/gate are alternatively directed toward the facing phosphor elements 7 of each color.

The assembly of the two substrates, or plates, 6 and 10, supporting anode 5 and cathode 1, respectively, provides an internal space 12 where the electrons emitted by cathode 1 flow.

A problem encountered lies in the formation of the space 12, because the distance between cathode 1 and anode 5 must be constant so that the brightness of the screen is regular over its whole surface.

For this purpose beads (not shown), for example made of glass and regularly distributed between gate 3 and anode 5, are conventional used. However a drawback of using beads distributed over the whole useful surface of the screen is that they constitute obstacles to the path of the electrons emitted by microtips 2. These obstacles cause shadow areas on the screen because the phosphor elements 7 facing them cannot receive electrons. Even though the spherical shape limits this effect by decreasing the contact surface between the spacer and a phosphor element 7, this is only true for small-diameter beads.

Indeed, the larger the diameter of the beads, the more visible these beads are on the screen surface by generating shadow areas. This requires the use of small-diameter beads, which limits the thickness of the vacuum space 12 and therefore the distance between anode 5 and cathode 1. The smaller the distance between anode 5 and cathode 1, the lower the anode-cathode voltage must be to prevent the formation of electric arcs which would destroy the screen. However, the anode-cathode voltage is directly related to the screen's brightness. Thus, when one wishes to reduce the shadow areas due to the spacers by decreasing the diameter of the spacers, the anode-cathode voltage must be reduced, and the screen's brightness is decreased.

The diameter of the beads is conventionally limited to approximately 200 μm to avoid generation of shadow areas. The anode-cathode voltage is then limited to approximately 500 to 1000 volts.

SUMMARY OF THE INVENTION

An object of the present invention is to avoid the above drawbacks by providing a microtip screen which can operate with a high anode-cathode voltage.

To achieve this object, the present invention provides a flat display screen having a cathode including microtips for electron bombardment associated with a gate, an anode including phosphor elements, and an inter-electrode gap. This screen further includes an insulating plate for defining this gap and is associated with means for maintaining this plate apart from the anode, the plate having holes facing microtip areas.

According to an embodiment of the invention, the means for maintaining the plate apart are formed by beads distributed between the plate and the anode.

According to an embodiment of the invention, the means for maintaining the plate apart are formed by bosses included in the surface of the plate facing the anode.

According to an embodiment of the invention, the plate further includes, outside the useful surface of the screen, an aperture for accommodating a getter.

According to an embodiment of the invention, the plate is coated, on the anode side, with a conductive layer.

According to an embodiment of the invention, the conductive layer is reflecting toward the anode.

According to an embodiment of the invention, the conductive layer is made of an impurity trapping material.

According to an embodiment of the invention, the plate is made of glass, and the holes are photoformed.

According to an embodiment of the invention, the plate's thickness is between 0.2 and 2 mm, and the means for maintaining the plate apart from the anode have a predetermined thickness ranging from 0.05 to 0.2 mm.

The foregoing and other objects, features, aspects and advantages of the invention will become apparent from the following detailed description of the present invention when taken in conjunction with the accompanying drawings.

BRIEF DESCRIPTION OF THE DRAWINGS

For the sake of clarity, the figures are not drawn to scale and the same elements are referenced with the same reference characters in the various figures.

DETAILED DESCRIPTION

A feature of the present invention is to provide spacers whose structure does not impair the path of the electrons emitted by the cathode and having a thickness that does not affect the regularity of the light emission of the screen.

Figure 1:
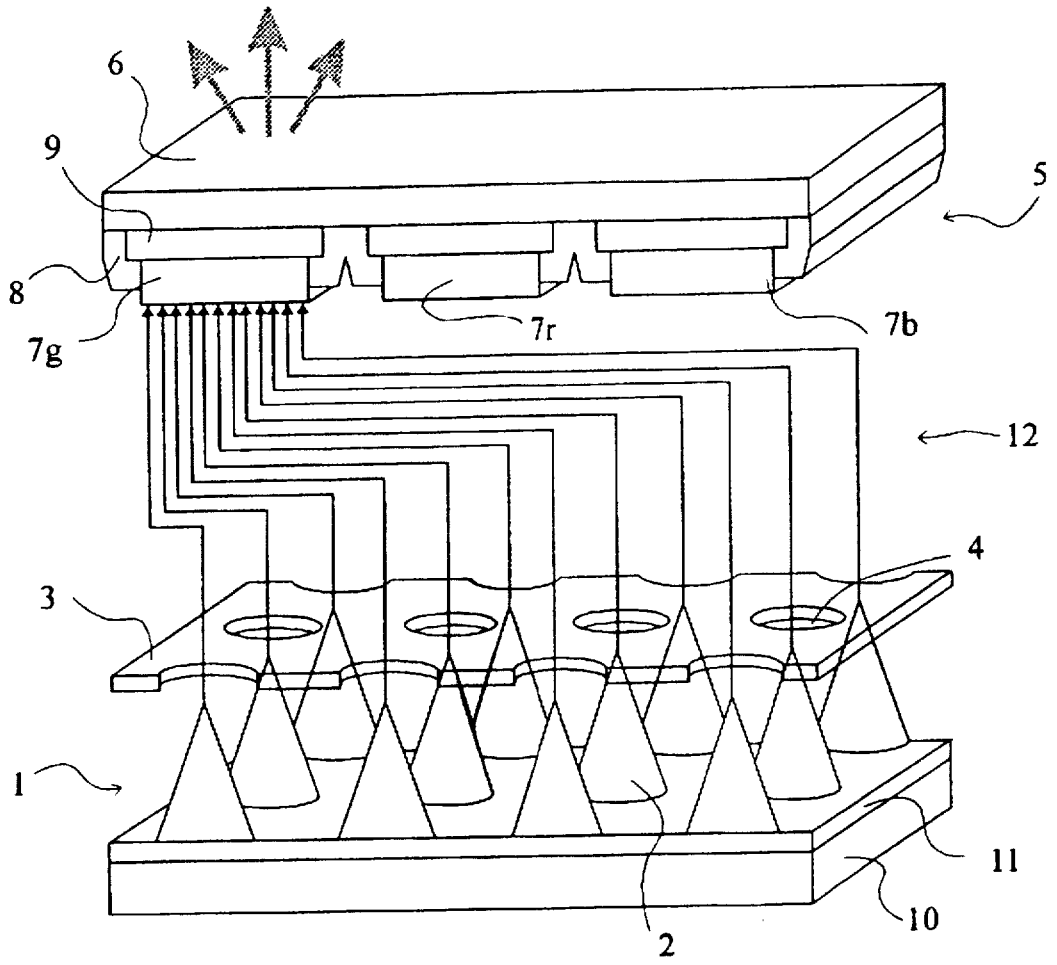
FIG. 1, above described, explains the state of the art and the problem encountered.
Figure 2:
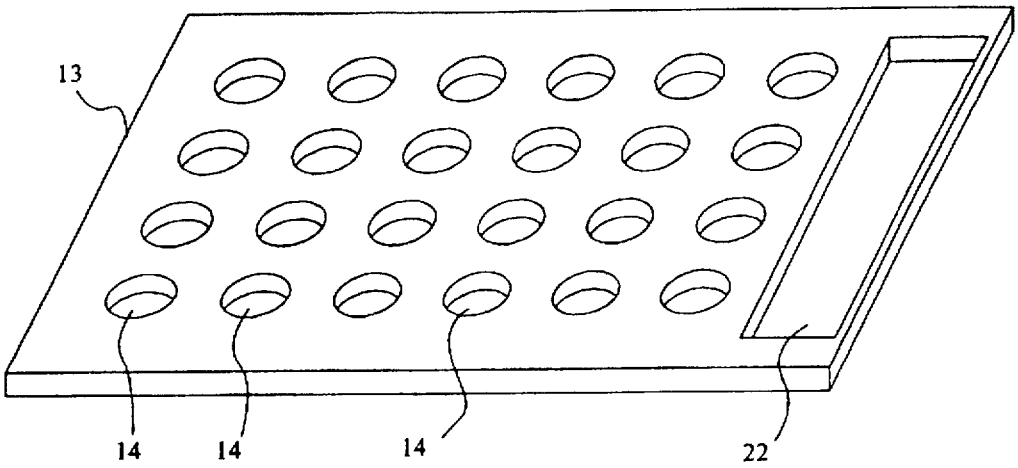
FIG. 2 is a perspective view of a spacer used according to an embodiment of the invention.

Thus, as shown in FIG. 2, the present invention uses an insulating plate 13 having a regular thickness and having substantially the same surface area as the cathode and the anode of the screen. The plate 13 has holes 14 facing each pixel defined by the intersection of a gate row and a cathode column, or facing each sub-pixel defined by the inside of a mesh of cathode conductors.

Figure 3:
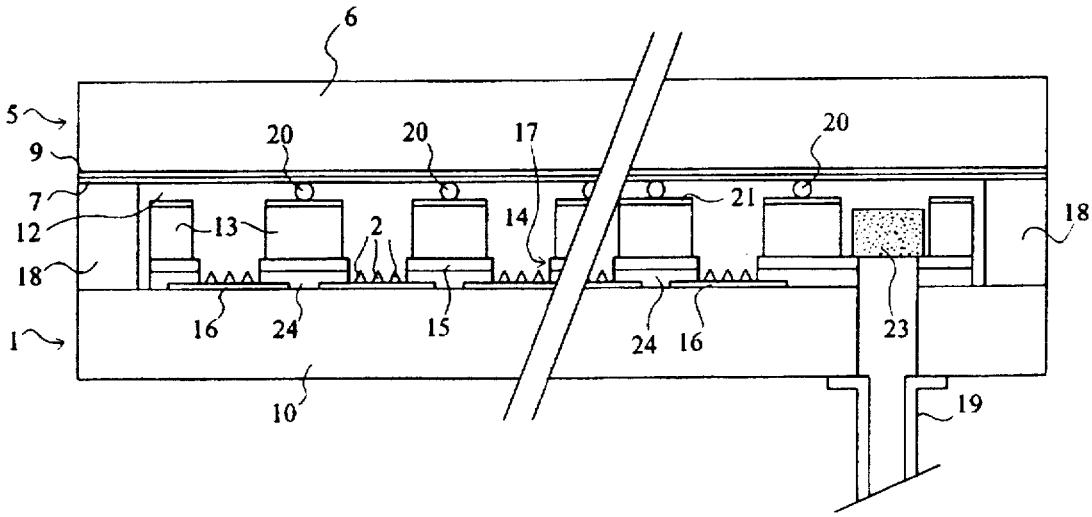
FIG. 3 is a schematic cross-sectional view of a flat display screen according to the invention.

As shown in FIG. 3, the plate 13 is associated with means for maintaining it apart from the anode 5. These means are, for example, small-diameter beads 20, distributed between plate 13 and anode 5 as represented in FIG. 3, or bosses directly formed on the surface of plate 13 which faces anode 5. Preferably, the bosses are shaped so that their contact surface with anode 5 is as small as possible. For example, the bosses can be spherical or tapered toward anode 5.

Thus, the association of plate 13 apertured by holes 14 with the means for maintaining it apart makes it possible not to have obstacles to electrons emitted by the microtips 2 of cathode 1 while having a large inter-electrode spacing.

Plate 13 is, for example, made of glass and holes 14 can, for example, be photoformed.

Holes 14 can be circular, square, or other. However, care should be taken so that the size of holes 4 and their periodicity in plate 13 are such that no moire effect is visible on the screen surface. For this purpose, care should be taken so that the surface of a sub-pixel, or of a pixel depending upon the selected embodiment, can be inside a hole 14. Preferably, the size of a hole 14 is slightly larger than the size of a pixel, or a sub-pixel, to take into account a possible slight misalignment when positioning plate 13 on gate 3.

As shown in FIG. 3, during the assembly of the screen, plate 13 is laid over gate 3, and the holes 14 of plate 13 face the intersections between rows 15 of gate 3 and columns 16 of cathode 1 or face meshes of the cathode conductors.

For the sake of clarity, the details of the meshes of the cathode conductors and the holes of gate rows are not represented in FIG. 3. FIG. 3 only shows in gate 3 apertures symbolizing intersection areas 17 between a row 15 of gate 3 and columns (referenced 16) of cathode 1, and therefore representing pixels of the screen. Similarly, for the sake of clarity, only a small number of microtips 2 appear on cathode 1, facing holes 17. In practice, the microtips 2 are several thousand per screen pixel and are distributed in the sub-pixels defined by the meshes of the cathode conductors. A similar representation is given, on the side of anode 5. The phosphor elements are represented by a layer referenced 7 and the anode conductors are represented by a layer referenced 9. On the side of anode 5, this representation could correspond to the structure of a monocolor screen.

Plates 6 and 10 are conventionally assembled by a sealing joint 18. The joint 18 can, for example, be formed by a molten glass seam.

To achieve a vacuum in space 12 after assembling plates 6 and 10, plate 10 is conventionally provided, outside its useful surface, with a pumping tube 19 leading into the space 12 from the external surface of plate 10. This pumping tube 19 is sealed at its free end once a vacuum is achieved in space 12.

The means for maintaining plate 13 apart from anode 5 (for example beads 20) enable communication between holes 14 and the pumping tube 19. The thickness of the separating means is for example a predetermined value ranging from 0.05 mm to 0.2 mm.

Accordingly, the invention makes it possible to set the thickness of the vacuum space 12 so that the anode and the cathode can be supplied with a much higher potential difference, thus improving the screen's brightness. The plate 13 has, for example, a thickness ranging from 0.2 mm to 2 mm.

By way of example, with 1-mm thick plates 13 associated with beads of approximately 0.2 mm in diameter, an anode-cathode voltage of approximately 10000 volts can be used without risk for electric arcs to occur.

The diameter of holes 14 of plate 13 depends on the size of the pixels or sub-pixels, this diameter has, for example, a predetermined value ranging from 60 μm to 300 μm. The distance between two holes 14 of plate 13 has, for example, a predetermined value of approximately 100 μm.

According to a preferred embodiment of the invention, plate 13 is coated with a metallization over its surface facing anode 5 to create a reflecting surface 21 which further increases the screen's brightness by reflecting toward the phosphor elements 7 the light they emit toward the inside of the screen. In addition, such a metallization 21 enables focusing back the electrons emitted by cathode 1 and therefore optimizing the brightness and the proximity contrast of the screen, the metallization 21 acting as a focusing gate.

A further advantage of the invention is that it makes it possible to use for anode 5, so-called high voltage phosphors 7. Moreover, the anode conductors which are conventionally made of a transparent material between plate 6 and the phosphor elements 7 can comprise a very thin aluminum film disposed over the phosphor elements 7, on the internal side. The power of the electrons emitted at a high anode-cathode voltage enables the electrons to pass through the thin aluminum film. This increases the brightness of the screen while increasing the proximity contrast.

In addition, the increased thickness of the interelectrode spacing 12 provides a particularly advantageous secondary effect.

The layers constituting the electrodes and the sealing joint 18 tend to outgas during the operation of the screen. Such an outgasing is damaging and makes it necessary to provide an impurity trapping element, or getter, in communication with the vacuum space 12. This getter is conventionally disposed in the pumping tube 19 before its sealing.

A resulting drawback is that the tube 19 significantly protrudes, perpendicularly to the plane of the screen whereas it is desired to form a display screen as flat as possible. The volume of the getter affects the life duration of the screen. The larger the getter, the longer the life duration of the screen, but the longer should be the tube 19 to accommodate the getter.

In practice, this involves that the pumping tubes 19 of conventional screens have a length of several centimeters, whereas it is desired that the useful surface of the screen be as flat as possible with a thickness of only a few millimeters. The total bulkiness of the achieved screen is thus larger than necessary.

The invention enables to directly incorporate a getter into the inter-electrode spacing 12, which is impossible in conventional screens because of the small thickness of the vacuum space 12.

Thus, the present invention reduces the total size of the screen by shortening the pumping tube 19 to a minimum length. This minimum length is related to the constraints inherent in the sealing of the tube 19 by molten glass of which, for example, it is formed because sealing must be achieved far enough from plates 6 and 10 to not damage them.

By way of example, with conventional techniques, a 6-mm long tube 19 is sufficient to seal the end of tube 19 without damaging plates 6 and 10.

The getter according to the invention can be disposed at various places.

According to an embodiment of the invention, the plate 13 is provided, near an edge of the screen, with an aperture 22 for accommodating getter 23. The useful volume of getter 23 is then more important and its increased external surface increases its trapping ability.

According to an alternative, metallization 21 deposited over the surface of plate 13 facing anode 5 is selected to act as a getter. The metallization 21 is then made of a suitable material, for example barium. An advantage of such an alternative is that it enables to homogenize trapping achieved by the getter in the vacuum space 12. Furthermore, if necessary, this embodiment enables to eliminate the pumping tube 19 by providing a very large-size getter.

According to a particular exemplary embodiment, the thickness of the various elements of a screen according to the invention are as follows.

Each plate 6 and 10 has a thickness of approximately 1 mm. On the side of anode 5, the thickness of the layer of anode conductors 9 is approximately 0.1 μm and that of the phosphor elements ranges from 4 μm to 10 μm. On the side of cathode 1, the thickness of columns 16 (the layer of cathode conductors and resistive layer) ranges approximately from 0.4 μm to 0.8 μm. The thickness of the insulating layer 24 between cathode 1 and gate 3 is approximately 1.3 μm. The thickness of gate 3 ranges approximately from 0.2 μm to 0.4 μm. The thickness of plate 13 ranges from 0.2 mm to 2 mm depending on the operating anode-cathode voltage of the screen. If the metallization layer 21 acts as a getter, its thickness is, for example, approximately 50 μm. The diameter of the beads is approximately 50 μm.

As is apparent to those skilled in the art, various modifications can be made to the present invention. In particular, each of the described elements of a layer can be replaced with one or more elements having the same characteristics and/or the same function.

Similarly, the sizes given by way of example can be modified as a function of the desired definition and features of the screen, of the materials that are used, or other. In particular, the thickness of plate 13 depends on the operating anode-cathode voltage of the screen. The diameter and the pitch of holes 14 depend on the size of the pixels or sub-pixels of the screen. The selection of the height of the means for maintaining the plate 13 apart from anode 5 (i.e., the diameter of beads 20) depends more particularly on the pitch of holes 14. These separating means can be other components than beads, for example pads, cylindrical columns, and so on.

I claim:

1. A flat display screen having a cathode (1) including microtips (2) for electronic bombardment associated with a gate (3), an anode (5) including phosphor elements (7), and an insulating plate (13) defining an inter-electrode gap (12), said insulating plate (13) having cylindrical holes (14) facing areas (17) of microtips (2), further comprising beads (20) distributed between the plate and the anode (5) for maintaining the plate apart from the anode.

2. The flat display screen of claim 1, wherein said plate (13) further includes, outside the useful surface of the screen, an aperture (22) for accommodating a getter (23).

3. The flat display screen of claim 1, wherein said plate (13) is coated, on the anode side (5), with a conductive layer (21).

4. The flat display screen of claim 1, wherein said conductive layer (21) is reflecting toward the anode (5).

5. The flat display screen of claim 3, wherein said conductive layer (21) is made of a gettering material.

6. The flat display screen of claim 1, wherein said plate (13) is made of glass, and wherein the holes (14) are photoformed.

7. The flat display screen of claim 1, wherein the thickness of said plate (13) is between 0.2 mm and 2 mm, and wherein the means (20) for maintaining the plate (13) apart from the anode (5) have a predetermined thickness ranging from 0.05 mm to 0.2 mm.

* * * * *